US005918463A

United States Patent [19]

Penswick et al.

[11] Patent Number: 5,918,463

[45] Date of Patent: Jul. 6, 1999

[54] BURNER ASSEMBLY FOR HEATER HEAD OF A STIRLING CYCLE MACHINE

[75] Inventors: Laurence B. Penswick, Richland; Raymond M. Erbeznik, Pasco, both of Wash.

[73] Assignee: Stirling Technology Company, Kennewick, Wash.

[21] Appl. No.: 08/779,716

[22] Filed: Jan. 7, 1997

[51] Int. Cl.[6] ..... F02G 1/04

[52] U.S. Cl. ..... 60/517

[58] Field of Search ..... 60/516, 517, 526

[56] References Cited

U.S. PATENT DOCUMENTS

| | | | |
|---|---|---|---|
| 4,004,421 | 1/1977 | Cowans | 60/516 |
| 4,057,962 | 11/1977 | Belaire | 60/526 |
| 4,172,363 | 10/1979 | Bex | 60/517 |
| 4,413,473 | 11/1983 | Morscrip | 60/517 |
| 4,984,428 | 1/1991 | Momose et al. | 60/517 |
| 5,356,487 | 10/1994 | Goldstein et al. | 136/253 |

OTHER PUBLICATIONS

*Pool Boiler Heat Transport System for a 25 KWE Advanced Stirling Conversion System*, from Proceedings From the 25th Intersociety Energy Conversion Engineering Conference, pp. 268–273, Paper No. 900163, vol. 5, 1990, by W.G. Anderson, et al.

*Primary Examiner*—Noah P. Kamen

*Attorney, Agent, or Firm*—Wells, St. John, Roberts, Gregory & Matkin, P.S.

[57] ABSTRACT

A burner assembly is taught for a heater head of an external combustion engine. Preferably, the external combustion engine is a Stirling cycle machine. The burner assembly includes a housing having a cavity sized to receive a heater head and a matrix burner element carried by the housing and configured to transfer heat to a received heater head. A fuel inlet also communicates with the housing for delivering fuel to the matrix burner element and an exhaust outlet communicates with the housing for delivering combustion gases from the matrix burner element to an exterior of the housing. According to another version, a burner and engine assembly are taught for generating power from a Stirling cycle machine. The burner/engine assembly includes a Stirling cycle power generator in combination with the above-recited burner assembly.

38 Claims, 7 Drawing Sheets

BURNER ASSEMBLY FOR HEATER HEAD OF A STIRLING CYCLE MACHINE

The Government has rights in this invention pursuant to Contract No. DAK60-94-C-0037 between the U.S. Army Natick RD&E Center and Stirling Technology Company.

TECHNICAL FIELD

This invention relates to heat sources for driving power generators, and more particularly to an improved burner assembly usable in combination with the heater head of a Stirling cycle machine.

BACKGROUND OF THE INVENTION

A number of closed-cycle thermodynamic machines operate by applying heat from a high-grade heat source to a heat user, such as a steam boiler or an external combustion thermodynamic heat engine. One example of such a heat user is a Stirling engine. Typically, this is accomplished by using a heat source in the form of a fossil fuel burner, or a concentrated solar energy source, to directly heat a heat exchanger integral with the heat user.

However, combustion systems that directly impinge on the heater heads of Stirling engines typically deliver heat to them at non-uniform temperatures. As a result, the non-uniform temperatures can compromise interior working gas bulk temperatures, causing the engine performance to drop. Additionally, local hot spots can excessively heat the engine structural materials.

One type of heater head that directly delivers heat to the heater head of a Stirling engine is a fossil fuel burner. One area where fossil fuel burners have been developed is where fossil fuel burners are used to deliver a primary heat source to a Stirling engine. Another area is as secondary, or backup heat sources where fossil fuel augments solar energy of a solar-powered electric system. Irrespective of whether they are supplied with burners used as primary or secondary heat sources, Stirling engines require the delivery of concentrated thermal energy at uniform temperature to the engine working fluid. Uniform temperatures enable a Stirling engine to realize maximum working efficiency, while past systems have mainly utilized engine burners that transfer most or all of the heat by convection. Furthermore, a typical Stirling engine has a heater head composed of many parallel, small-diameter tubes. The burner, or burner assembly, must accommodate such a heater head shape, usually resulting in a non-conforming interface that produces a poor interface between the burner and the engine head. As a result, many past systems utilizing direct impingement burners have resulted in poor performance that suffers from inherent non-uniformity of temperature. Particularly where the Stirling engine has a heater head composed of many parallel, small-diameter tubes, hot spot burnout is a substantial operating risk, particularly taking into account the long-term operation of the exposed heater tubes and brazed joints of heater heads within an oxidizing atmosphere.

In the approach presented in this disclosure, an improved burner assembly provides a burner assembly to heater head interface that transfers heat primarily by radiation, and secondarily by convection. The heater head utilizes commercially available low-emission burner technology. The externally positioned burner assembly delivers heat energy directly to the heater head along an improved interface that significantly reduces the risk of hot spots, greatly contributing to the extended life of the heater head. In this manner, operating performance can be maximized for a given peak metal temperature. Furthermore, exhaust gas energy can be effectively recovered to achieve high overall operating efficiency.

BRIEF DESCRIPTION OF THE DRAWINGS

Preferred embodiments of the invention are described below with reference to the following accompanying drawings.

FIG. 7 is an schematic view of another heat transport system using a metal pool boiler.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

In accordance with one aspect of this invention, a burner assembly is taught for a heater head of an external combustion engine. The burner assembly includes a housing having a cavity sized to receive a heater head and a matrix burner element carried by the housing and configured to transfer heat to a received heater head. A fuel inlet also communicates with the housing for delivering fuel to the matrix burner element and an exhaust outlet communicates with the housing for delivering combustion gases from the matrix burner element to an exterior of the housing.

In accordance with another aspect of this invention, a burner assembly is taught for a heater head of a Stirling cycle machine. The burner assembly includes a housing having a cavity sized to receive a heater head and a matrix burner element configured to encircle a received heater head in spaced apart relation. A fuel inlet also communicates with the housing for delivering fuel to the matrix burner element and an exhaust outlet communicates with the housing for delivering combustion gases from between the matrix burner element and the received heater head and to the exterior of the housing.

In accordance with yet another aspect of this invention, a burner and engine assembly are taught for generating power from a Stirling cycle machine. The burner/engine assembly includes a Stirling cycle power generator having a heater head for receiving a supply of heat and a burner assembly carried over the heater head to form a heater for powering the generator. The burner assembly includes a housing having a cavity sized to receive the heater head and a matrix burner element configured to encircle the heater head in spaced apart relation. A fuel inlet communicates with the housing for delivering fuel to the matrix burner element and an exhaust outlet communicates with the housing for delivering combustion gases from between the matrix burner element and a received heater head and to the exterior of the housing.

Figure 1:
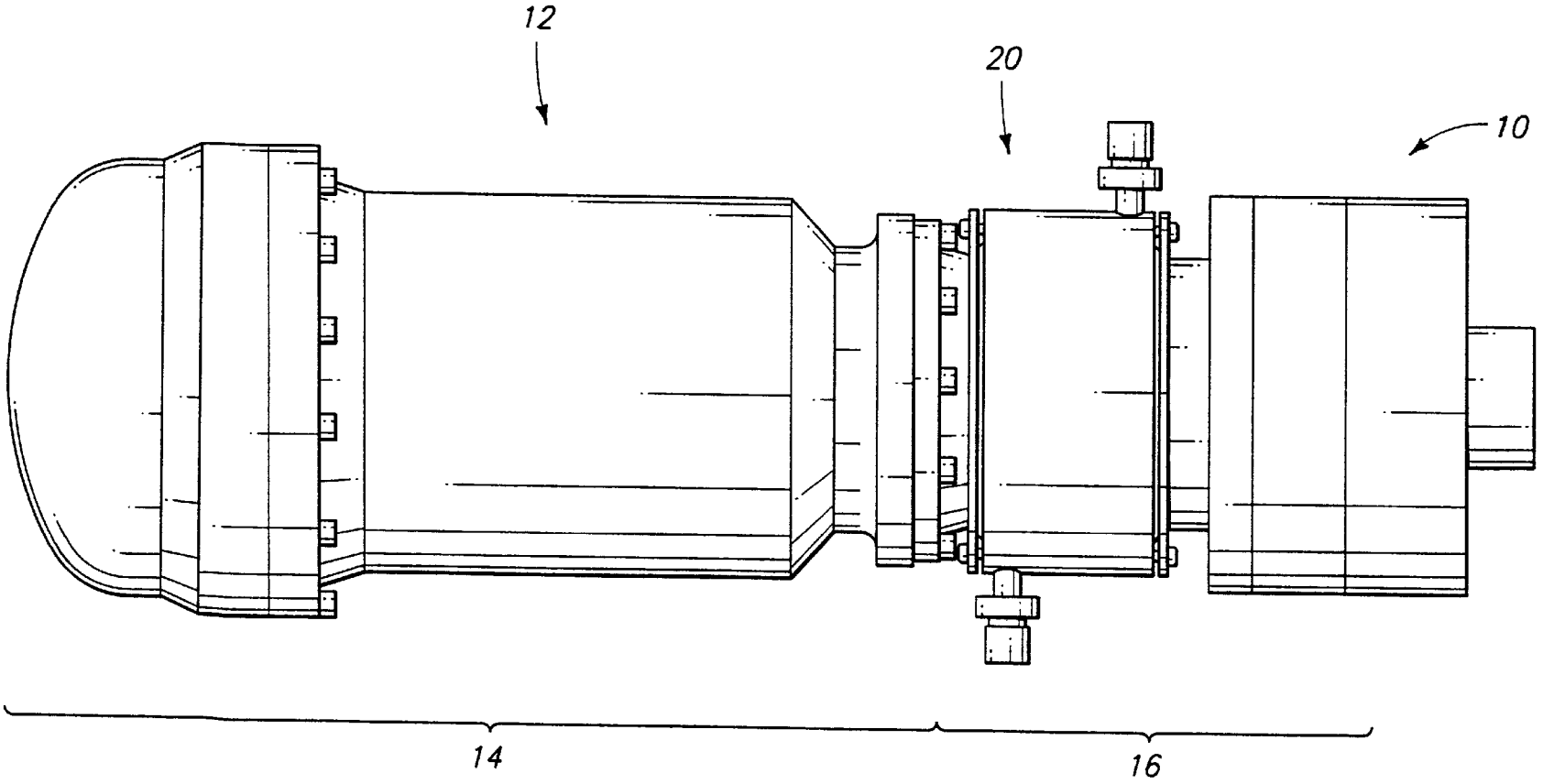
FIG. 1 is a side elevational view of a Stirling power generator with an external burner assembly embodying this invention.
Figure 3:
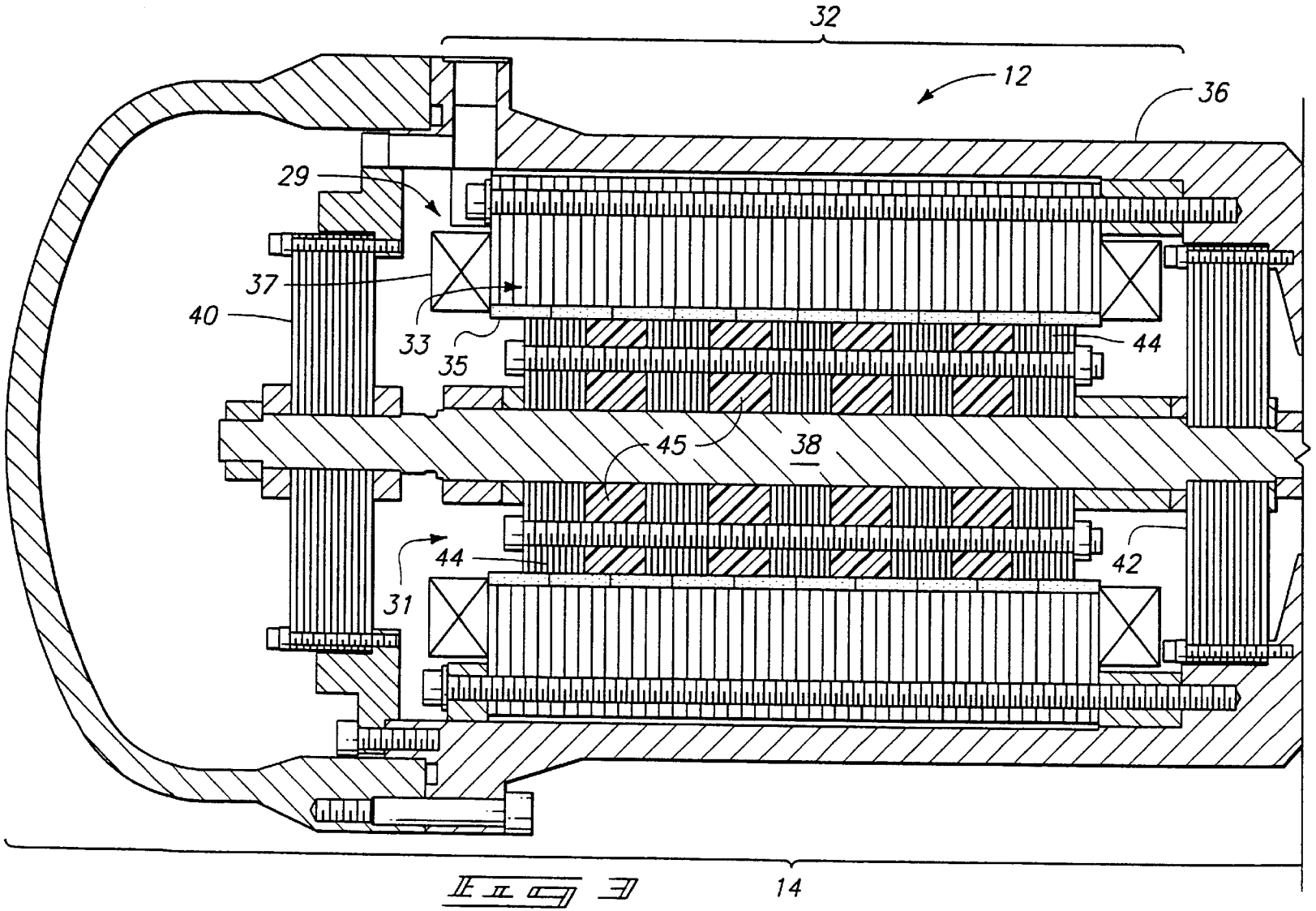
FIG. 3 is a first portion of FIG. 2 illustrating a vertical sectional view of an exemplary Stirling power generator having an external heater embodying this invention.
Figure 4:
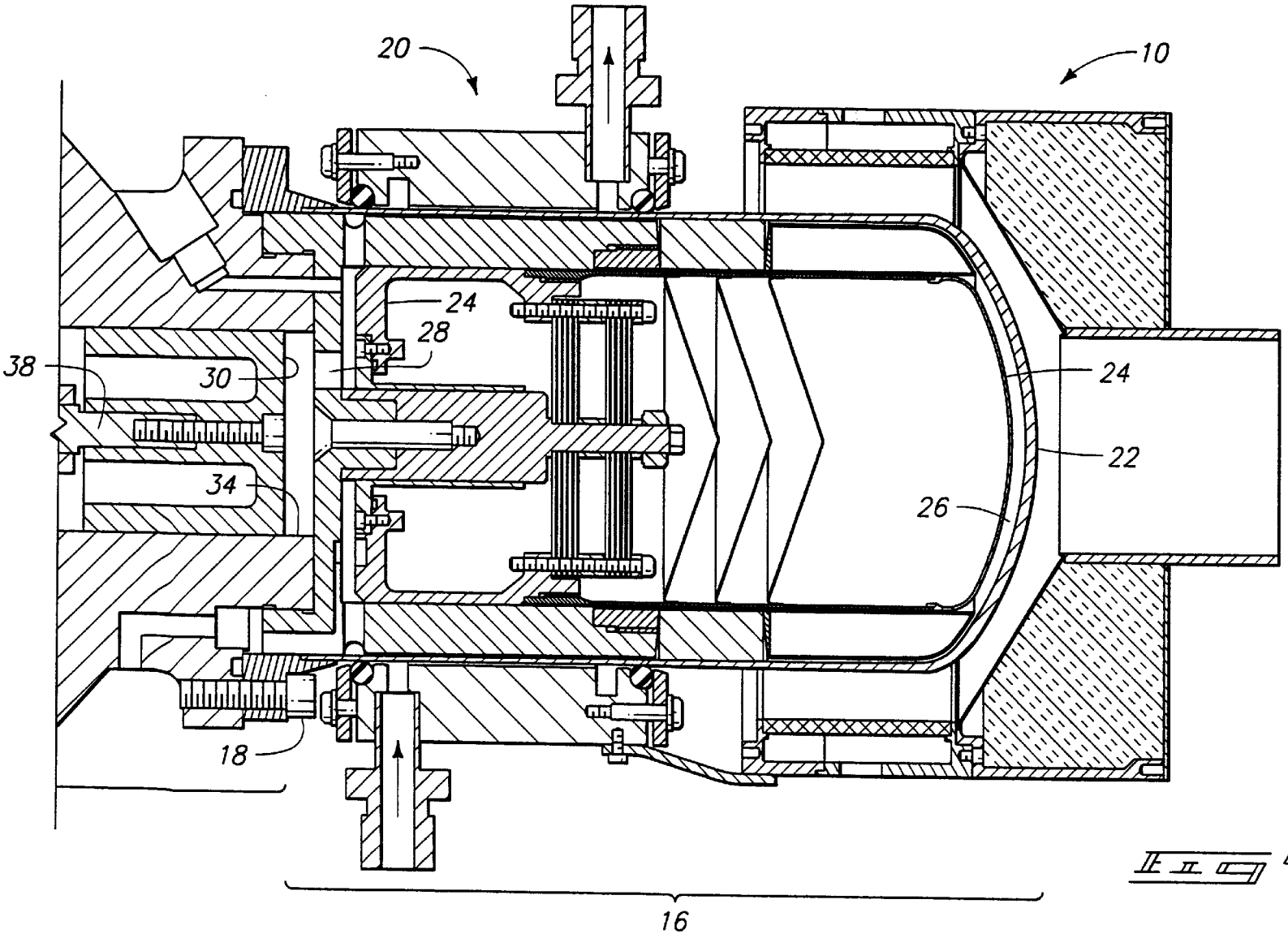
FIG. 4 is a second portion of FIG. 2 illustrating a vertical sectional view of an exemplary Stirling power generator having an external heater embodying this invention.

A preferred embodiment external burner assembly, or burner, configured as a heat source for use on a Stirling power generator is generally designated with reference numeral "10" in FIG. 1. The Stirling power generator has an engine module assembly and a power module assembly and is generally designated with reference numeral "12" in FIG. 1. Stirling power generator 12 is formed by joining together a power module 14 and an engine module 16 with a plurality of circumferentially spaced apart threaded fasteners 18. According to an alternative embodiment, power module 14 and engine module 16 can be joined together with a circumferential weld, providing a hermetically sealed power generator. Such a hermetically sealed generator prevents leakage of working gases from inside the generator, eliminating any need to replenish working gases contained inside. The inside of power generator 12, as shown in FIGS. 3–4, is filled with a charge of pressurized thermodynamic working gas such as helium. Alternatively, hydrogen or any of a number of suitable thermodynamically optimal working fluids can be used to fill and charge the inside of power generator 12.

Figure 2:
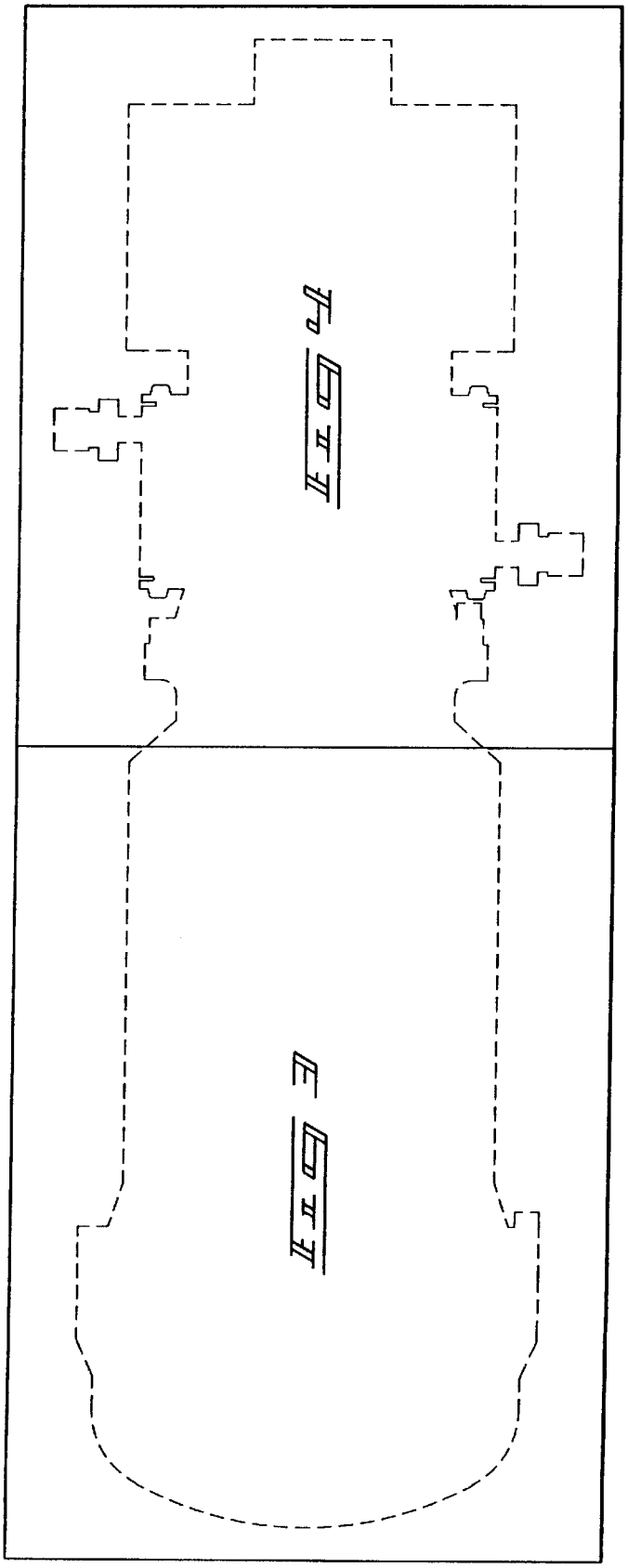
FIG. 2 is a layout illustrating the assembly of FIGS. 3 and 4.

According to FIGS. 3–4, as assembled according to the layout of FIG. 2, burner assembly 10 forms a heat source, or heater that applies heat to the heater head 22 of engine module 16, causing power module 14 to generate a supply of electric power. The outer surface of heater head 22 forms a combustion energy absorbing surface of power generator 12. A displacer 24, comprising a movable displacer piston that is assembled together with several separate components, reciprocates between a hot space 26 and a cold space 28 in response to thermodynamic heating of the hot space from heater head 22 via burner assembly 10. In operation, displacer 24 moves working gas back and forth between hot space 26 and cold space 28. A power piston 30, suspended by flexure bearing assemblies 40 and 42, reciprocates within power module housing 36 in direct fluid communication with cold space 28. Power piston 30 moves in response to cyclic pressure variations of working fluid contained within cold space 28 caused by reciprocation of displacer 24. Reciprocation of displacer 24 causes a principal volume of working fluid to alternatively occupy hot space 26 and cold space 28. Details of such a Stirling power generator are similar to those disclosed in our U.S. patent application Ser. No. 08/637,923 filed on May 1, 1996, and entitled "Heater Head and Regenerator Assemblies for Thermal Regenerative Machines", listing inventors as Laurence B. Penswick and Raymond M. Erbeznik. This 08/637,923 application, which is now U.S. Pat. No. 5,743,091, is hereby incorporated by reference.

Power generator 12 produces electrical power when burner assembly 10 applies heat to heater head 22 as shown in FIG. 4. Displacer 24 reciprocates in a self-driven mode pursuant to a well-understood process in the art of Stirling cycle machines. Details of such process are disclosed in the above-referenced U.S. patent application Ser. No. 08/637,923, already incorporated by reference. A linear alternator 32 is formed within housing 36 from stator laminations 33 to which are bonded permanent magnets 35 and coil windings 37. Laminations 33, magnets 35 and windings 37 cooperate to form a stator assembly 29. Stator assembly 29, which is stationary, cooperates with an armature assembly 31, or moving portion of linear alternator 32, to produce electrical power. Armature assembly 31 includes armature laminations 44 that alternate with non-magnetic spacers 45 in uniaxially repeating sequence and are together locked in intimate contact with alternator shaft 38. Armature assembly 31 is reciprocated within stator assembly 29 as a result of its integral connection with a power piston 30, which in turn is driven by fluid pressure variations created by reciprocation of displacer 24. Reciprocating motion of armature assembly 31 connected to power piston 30, which moves within a receiving bore 34 of a power module housing 36, causes linear alternator 32 to produce electrical power. A pair of flexure bearing assemblies 40 and 42 support piston 30 and shaft 38 in accurate, axially movable relation relative to bore 34, forming a clearance seal between bore 34 and power piston 30.

Figure 5:
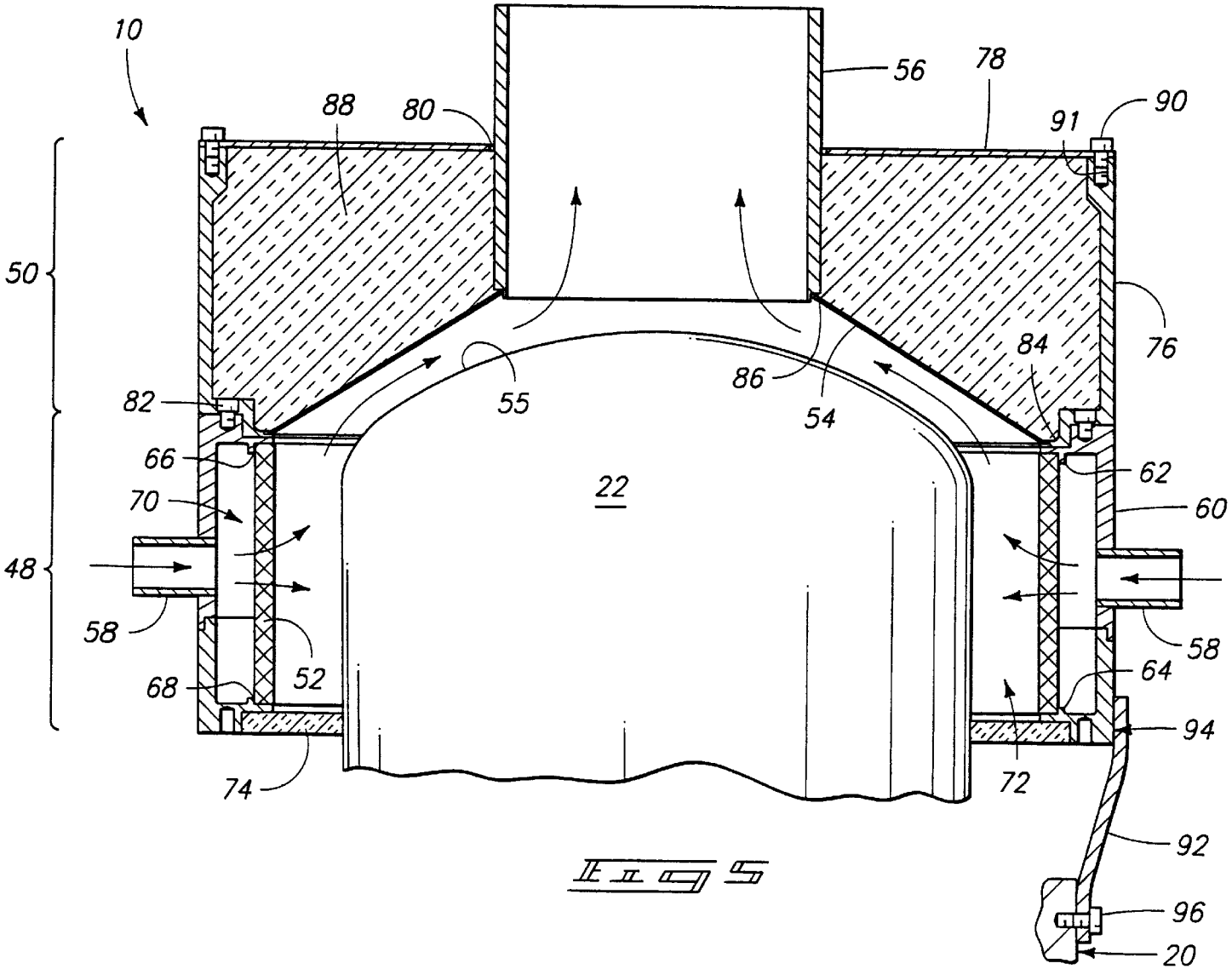
FIG. 5 is an enlarged vertical sectional view of the burner assembly of FIG. 1.

As shown in greater detail in FIG. 5, burner assembly 10 generates heat that is directly applied to heater head 22 of power generator 12. Burner assembly 10 is formed by a burner housing 48 and an exhaust housing 50. Burner housing 48 supports a fiber matrix burner element 52 in radially spaced apart, but close proximity to a radially outer surface of heater head 22. Matrix burner element 52 is preferably constructed from a cylindrical section of Metal Fibre Burner (MFB) mat manufactured and sold by Acotech of Bekaertstraat 2, B-8550, Zwevegem, Belgium. MFB mat forms a permeable medium consisting of fine metal fibers of 22 micrometers diameter sintered together to produce a semi-rigid but highly porous matrix. Matrix thicknesses are available from 1 to 4 mm. Optionally, a perforated version of MFB mat is available, allowing for gas/air flow directed preferentially into the perforations. This leads to a more homogeneous combustion for radiant and blue flame burn modes, and allows a smooth transition between the various burn modes. The fibers are made out of Fecralloy, an alloy registered by the U.K. Atomic Energy Authority. Fecralloy is a refractory steel having outstanding oxidation resistance at temperatures over 1000° C. (1830° F.). Yttrium, an element of the alloy composition, anchors the protective surface alumina layer to the base metal in a very tenacious way. Alternatively, matrix burner element 52 may be fabricated from metal fibers with differing sizes or constituents, or from non-metallic materials such as ceramics.

Burner assembly 10 receives a gas/air mixture to allow for surface combustion on the MFB mat, as shown in FIG. 5. Surface combustion is a gas burning technique in which premixed gas and air burn on a surface layer of a permeable and/or perforated medium. Depending on the intensity, the combustion can occur in two modes: radiant and blue flame. In the radiant mode, combustion occurs inside matrix burner element 52. The permeable matrix of element 52 then heats to incandescence and releases a major portion of the energy, outputting this energy as thermal radiation. Flame color is a red/orange. In the blue flame mode, blue flames hover above the surface and release the major part of the energy in a convective way.

Matrix burner element 52 is shaped and positioned to conform substantially to the radial outermost surface of heater head 22, adjacent a torospherical end portion 55 as shown in FIG. 5. Additionally, matrix burner element 52, exhaust collector 54 and exhaust outlet 56 cooperate to produce a heat chamber that imparts fluid flow of heated exhaust gases in a manner which substantially conforms to the exterior shape of the heater head, both axially along the cylindrical outermost surface and radially inward along the hemispherical head. In this manner, heat transfer from the heated exhaust gases to heater head 22 is enhanced via fluid flow being produced over the outer surface of heater head 22. Essentially, the hot exhaust gas fluid flow substantially envelopes and engages the outer surface of heater head 22, circumferentially surrounding the heater head.

Exhaust housing 50 supports an exhaust collector 54 directly adjacent matrix burner element 52, as shown in FIG. 5. Collector 54 is supported in close proximity with a torospherical end portion 55 of heater head 22. Accordingly, collector 54 directs a flow of hot combusted air/fuel mixture burned in matrix burner element 52 over the surface of the torospherical end portion 55 of heater head 22. An exhaust outlet 56 communicates with exhaust collector 54 to draw the combusted air/fuel mixture from matrix burner element 52 to an exhaust pipe (not shown). Exhaust collector 54 and exhaust outlet 56 together form a hot exhaust fluid flow conduit that guides the hot exhaust gases over the heater head 22 to transfer heat therealong. The resulting conduit can be of a multi-sided shape (collector 54 and outlet 56), conical shape, spherical shape, cylindrical shape, hemispherical shape, or even any generally concave shape. It is even envisioned that multi-sided shapes can be regular or irregular. However, preferably, the configuration of the burner structure and resulting conduit will complement the exterior wall surface of heater head 22, separated by a uniformly spaced heat chamber. The configuration thus serves as a fluid flow path guide that transfers heat from directed combustion gases in the heat chamber to the energy absorbing surface on the heater head outer surface.

Preferably, a twenty-seven to one ratio of air to propane is used as the air/fuel mixture for matrix burner element 52. Alternatively, natural gas or methane can be substituted for propane. Even further, any combustible gas/air mixture, or even an appropriate liquid fuel/air mixture, can be used to fuel matrix burner element 52.

Preferably, two fuel inlets 58 are provided for delivering a mixture of gas/air into burner housing 48 where it is combusted near the inner surface of fiber matrix burner element 52. Alternatively, a single inlet, or a plurality of circumferentially spaced apart inlets can be used. Housing 48 is formed substantially from a one-piece cylindrical supply duct member 60 having an upper flange 62 and a lower flange 64 sized to receive matrix burner element 52 therebetween. Each flange 62 and 64 has an inner lip edge 66 and 68, respectively, that seats against a radial outer top and bottom edge of matrix burner element 52, further assisting to hold the matrix burner element in place. Additionally, matrix burner element 52 is brazed to flanges 62 and 64, and lip edges 66 and 68, securing it into place within housing 48. Alternatively, matrix burner element 52 can be welded to flanges 62 and 64, held in place by a compression fit, or bonded in place by use of a metal adhesive.

As shown in FIG. 5, a plenum chamber 70 is formed circumferentially about matrix burner element 52 for delivering fuel evenly to matrix burner element 52, about its entire cylindrical outer surface. Plenum chamber 70 is formed between an outer surface of matrix burner element 52 and an inner surface of member 60. A mixture of fuel and air is delivered into plenum chamber 70 via fuel inlets 58. Plenum 70 can be configured with any physical structure suitable for directing air (or air/fuel mixture) into matrix burner element 52. Preferably, plenum 70 directs the air/fuel mixture relatively evenly around matrix burner element 52, where it then enters the matrix burner element with a relatively even circumferential distribution, and a radially inward flow direction. Even further, air and fuel can be delivered separately as long as they arrive together at matrix burner element 52 for combustion therein/therealong. Principally, heat is transferred by radiation, with some convection occurring.

A heat chamber 72 is also formed within housing 48, between an inner surface of matrix burner element 52 and an outer surface of heater head 22. Heat transfer occurs within chamber 72 primarily via radiation from matrix burner element 52 to heater head 22, and secondarily via hot exhaust gases to heater head 22. Additionally, a washer-shaped piece of flexible, semi-rigid, or rigid, fibrous ceramic insulation 74 is carried by duct member 60 of housing 48, further enclosing heat chamber 72. Insulation 74 prevents flow of hot combustion gases from heat chamber 72 through an otherwise open bottom portion of chamber 72. Instead, hot combustion gases are directed out from heat chamber 72, through exhaust collector 54, and into exhaust outlet 56 where they are drawn out via an exhaust pipe (not shown).

It is to be understood that a conventional ignition system (not shown) will be provided for the fiber matrix burner element 52 to effect initial combustion of burner fuel.

Matrix burner element 52 as shown in FIG. 5 can be a porous ceramic or a fine mesh metallic matrix. Fiber matrix element 52 functions as a flame holder to maintain combustion principally within the fiber matrix element at or near its concave face, rather than further inward in heat chamber 72. Such action serves to quench peak combustion temperatures relative to what they would be if combustion were to occur in open air or in heat chamber 72. For example, temperatures can be quenched from perhaps 2000° C. to about 1100° C. The resulting lower combustion temperature greatly reduces undesirable pollutants, especially oxides of nitrogen or $NO_X$.

Much of the heat energy resulting from this combustion is immediately directed onto the outer surface of heater head 22 by radiation (about 80%). The moving hot exhaust gases also transfer additional heat energy to heater head 22 by convection (about 20%). More traditional burner assemblies transfer about 90% of the energy by radiation and 10% by convection. The exhaust gases can then optionally be directed into a recuperator 98 (of FIG. 6) where more exhaust heat is transferred to the incoming air/fuel mixture to provide energy efficient preheating of the incoming air/fuel mixture.

Preferably, insulation 74 is formed from a washer-shaped piece of fibrous ceramic insulation. One suitable brand of fibrous ceramic insulation is KAOWOOL, a thermal ceramic material sold in blanket form by KAOWOOL of Augusta, Ga.

Exhaust housing 50 is formed substantially from a one-piece cylindrical exhaust duct member 76, inside of which exhaust collector 54 and exhaust outlet 56 are at least partially housed. A cover 78 is mated with the end of exhaust duct member 76 distal of burner housing 48. An aperture 80 provided centrally of cover 78 allows clearance for passage of exhaust outlet 56 from exhaust housing 50. A plurality of circumferentially spaced apart threaded fasteners 82 removably secure exhaust housing 50 to burner housing 48. In this manner, a new collector and exhaust outlet shape can be quickly and easily substituted in burner assembly 10 to conform to the exterior shape of a heater head being heated. A lower portion of exhaust housing 50, opposite cover 78, is separated from burner housing 48 by collector 54. More particularly, collector 54 is secured to exhaust duct member 76 with a circumferentially extending weld. Likewise, exhaust outlet 56 is secured to an opposite end of collector 54 with a circumferentially extending weld. Insulation 88 is packed between the radial outer surfaces of collector 54 and exhaust outlet 56, cover 78, and exhaust duct member 76. To withstand hot exhaust temperatures, preferably, collector 54 is formed from Inconel, whereas the remaining metallic components of burner assembly 10 are formed from stainless steel, except for matrix burner element 52.

Preferably, insulation 88 is formed from fibrous ceramic insulation such as KAOWOOL, previously described above. Additionally, a blanket of such fibrous ceramic material can be wrapped about the exterior of burner assembly 10, along the outer surfaces of supply duct member 60, exhaust duct member 76, and cover 78. Such a blanket of material (not shown) would further reduce heat loss from burner assembly 10, increasing heat transfer efficiency from matrix burner element 52 to heater head 22. Even further, such blanket of fibrous material can be covered with a reflective foil such as aluminum. Alternatively, a rigid or semi-rigid insulation can be substituted for KAOWOOL when forming the blanket, or forming insulation 74 or 88.

Insulation 88 reduces heat loss through collector 54 and exhaust outlet 56, in the vicinity of heater head 22. Heat being delivered through heat chamber 72 and over heater head 22 is conserved as a result of insulation 88, increasing heat transfer from burner assembly 10 to power generator 12. As a result, power generator 12 runs more efficiently, having reduced heat loss as a result of insulation 88.

A plurality of threaded fasteners 90 provided in circumferentially spaced apart relation about cover 78 secure cover 78 to the open top end of exhaust duct member 76. Corresponding threaded female bores 91 in member 76 receive the threaded fasteners in threaded engagement.

Burner assembly 10 is removably secured in position over heater head 22 of power generator 12 with a plurality of circumferentially spaced apart mounting brackets 92. Each bracket 92 is secured to a radial outer surface of burner housing 48 with one or more welds 94. A threaded fastener 96 is used to secure the free end of mounting bracket 92 to a radial outer surface of heat rejector 20. In this manner, burner assembly 10 can be easily mounted and demounted from atop heater head 22 by securing or removing fasteners 96, respectively. Additionally, brackets 92 can be axially adjusted during mounting to adjust the relative positioning of burner assembly 10 over heater head 22, enabling accurate placement of matrix burner element 52 over the heater head 22. Accordingly, a more uniform annular flow of hot exhaust (combustion) gases passes through heat chamber 72 and over heater head 22, preventing or reducing the potential for local hot spots along head 22. Such hot spots can significantly shorten the life of head 22, and prevent most efficient use of burner assembly 10 with head 22.

In operation, preheated air/fuel mixture is directed into plenum chamber 70 from inlets 58 between member 60 and matrix burner element 52. The air/fuel mixture flows radially inward through the porous matrix material of matrix burner element 52, where it is ignited adjacent to a substantial area of the inner wall forming the heat transfer space of heat chamber 72. The exhaust gases from the matrix exit into chamber 72 where they exit burner assembly 10 through exhaust collector 54 and exhaust outlet 56.

This disclosure is not limited to a metal fiber matrix burner element. The burner element can be open or contained. It might be either catalytic or noncatalytic, and can be operated in a constant burning mode or by known pulse techniques. It can transfer heat to the outer surface of heater head 22 by conduction, convection, or radiation, or by any desired combination of these common heat transfer technologies.

Forming matrix burner element 52 to conform to the outer surface of monolithic heater head 22 is desired. Alternative burner shapes are envisioned where the cylindrical matrix burner element can be constructed in simple geometric shapes, such as a section of a cone or cylinder. Alternatively, Stirling engine heater head configurations can also be employed with burner assembly 10. One well-known example of a Stirling heater head configuration is formed from multiple small diameter tubes which interconnect the hot expansion space 26 with the hot end of the regenerator section.

Figure 6:
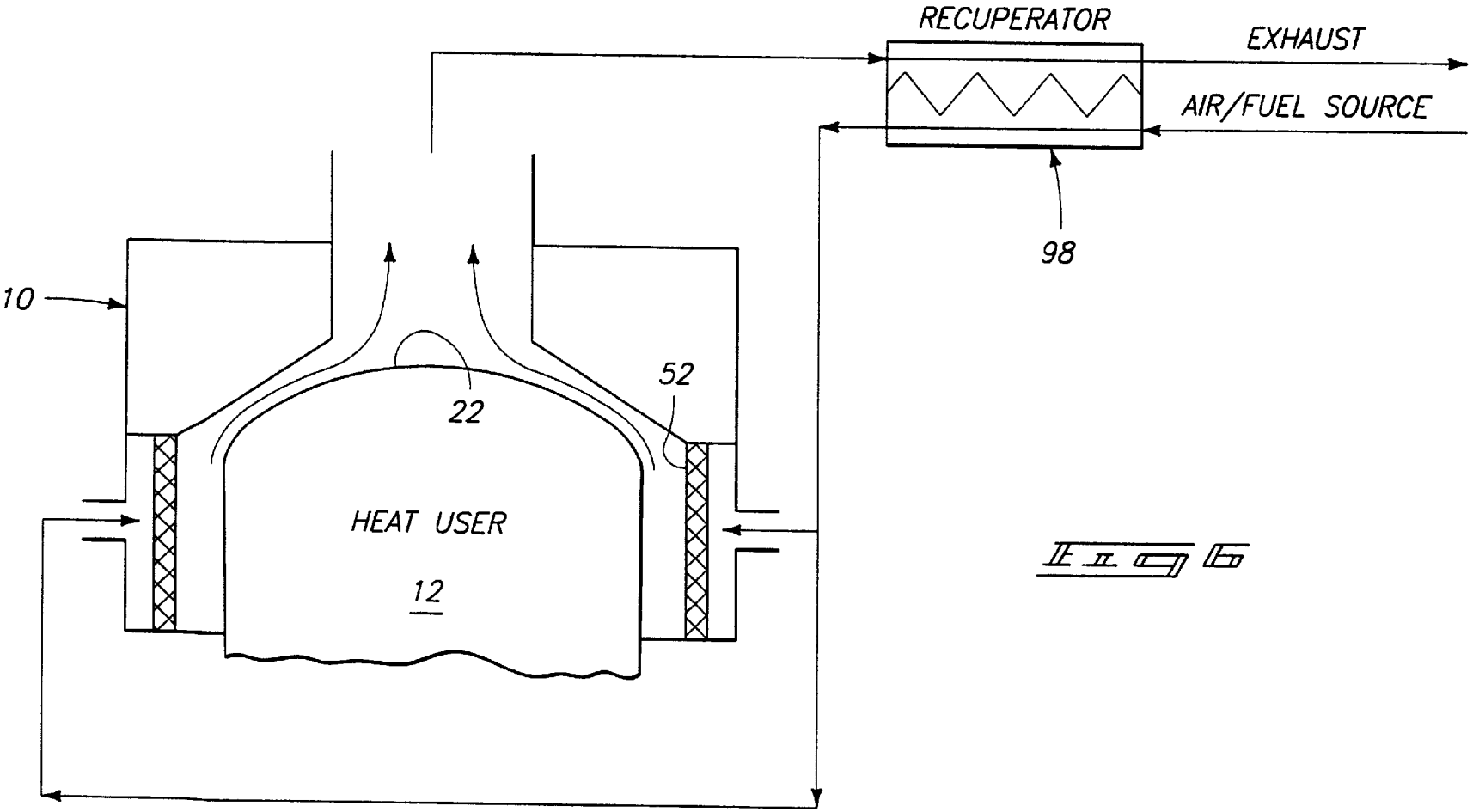
FIG. 6 is a schematic view of a heat transport system usable with the burner assembly of this invention.
Figure 11:
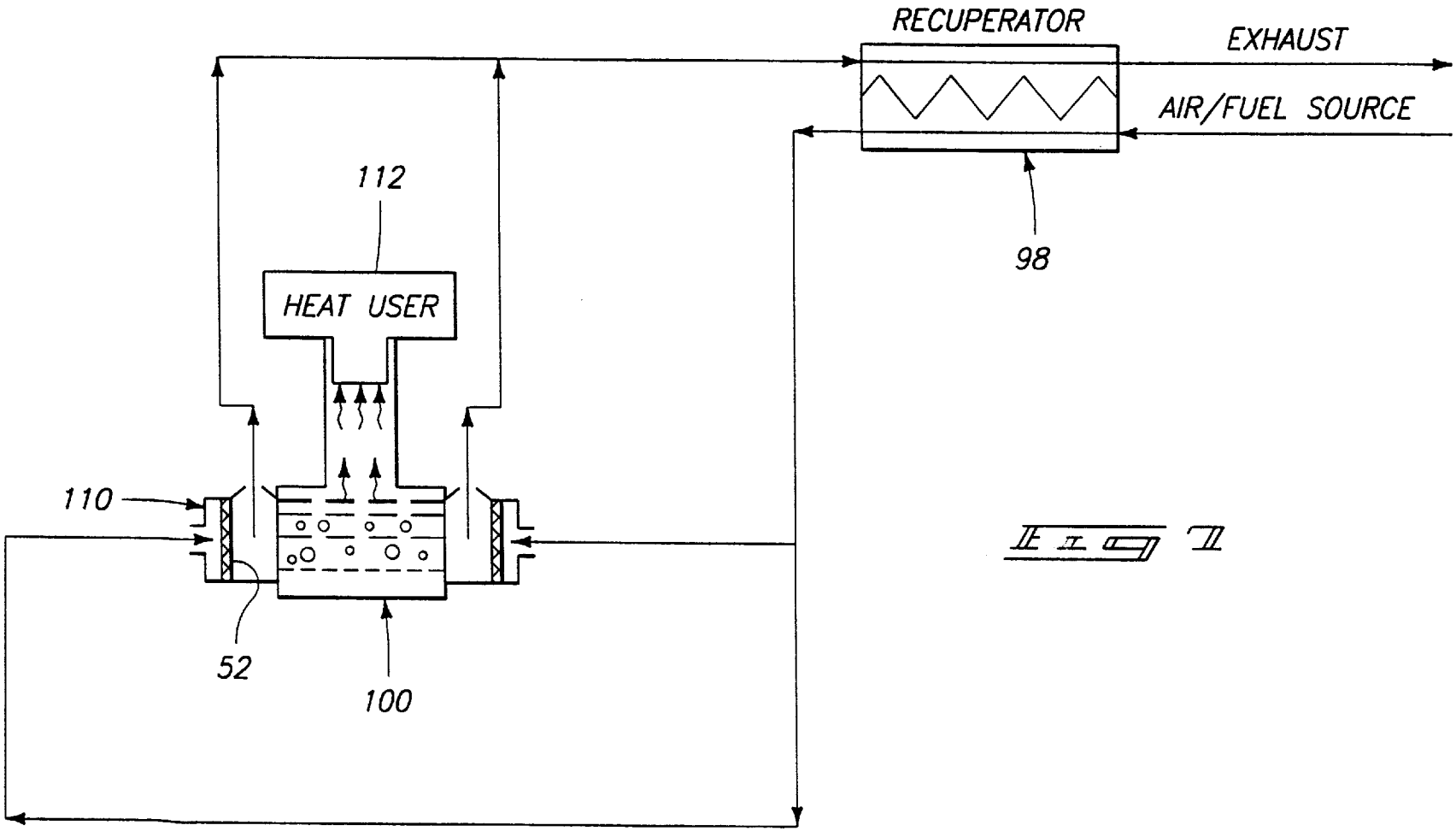

FIG. 6 illustrates the implementation of a recuperative heat exchanger 98 in combination with external burner assembly 10 of this invention for supplying heat to a heat user (power generator) 12. Heat user 12 is preferably a power generator, a heater head 22 of the power generator 12 being received in burner assembly 10. More particularly, recuperator 98 preheats the air/fuel source as it is being fed to burner assembly 10 by capturing heat from exhaust gases that leave burner assembly 10.

The confined air/fuel supply and exhaust streams flow in opposite directions through recuperator 98 shown schematically in FIG. 6. In essence, recuperator 98 is a heat exchanger for transferring heat from the exhaust gases to the incoming air (or air/fuel mixture). Recuperator 98 can be incorporated within the burner assembly 10 itself, or at a separate physical location exterior to the receiver. It both preheats the air supply and cools the exhaust for improved system efficiency and more manageable exhaust gas temperatures.

FIG. 7 illustrates an alkali metal pool boiler heat transfer system 100 used to transfer heat in a more uniform manner to a heat user from a burner assembly 110. Burner assembly 110 is constructed similar to the construction of FIGS. 1–6, with a matrix burner element 52. Heat user 112 is an external combustion engine, preferably a Stirling cycle generator having a monolithic heater head 22. Head 22 of user 112 is received in a cavity of pool boiler 100. Pool boiler 100 and burner assembly 110 are fixedly connected together to form a common housing. Alternatively, with the improved uniform heat transfer provided by pool boiler 100, heater head 22 can be formed from a multiple tube construction of heater head tubes, yet still maintain operating efficiency. With this construction, pool boiler 100 provides an intermediate heat transfer device interposed between burner assembly 110 and heat user 112.

Pool boiler 100 forms a heat transport system, including a heat transfer space partially filled by a supply of liquid capable of a phase change to a vapor upon reception of heat energy received from burner assembly 110. The vapor then rises to transfer heat to heat user 112 as it condenses on its exposed surfaces. Pool boiler 100 transports heat to heat user 112, typically a Stirling engine, by exposing the vapor to a heater head of the user 112. Burner assembly 110 forms a physically integrated combustion burner, preferably using a fossil fuel such as natural gas and air, to provide energy directly to the liquid within the heat transfer space of the pool boiler 100 as needed.

Pool boiler 100 according to FIG. 7 acts basically as a thermal transformer between burner assembly 110 and heat user 112 to which heat is being directed. The excellent heat transfer characteristics allow for efficient thermal transfer between burner 110 and heat user 112, while accommodating various heater head configurations for heat user 112, thereby minimizing heat losses. In this manner, heat is transferred to heat user 112 along its absorber surfaces in a manner that is physically separated from the geometric configuration of the heater head or other heat exchanger to which heat is being transferred on heat user 112. This allows both to be independently designed and optimized.

Liquid metal has been chosen as a heat transfer medium within pool boiler 100 in order to utilize high transfer temperatures for efficiency purposes. A typical metal used in this type of system is a eutectic combination of sodium and potassium (NaK). Such alkali metals are well known in high temperature systems for heat transfer purposes. They are capable of a phase change as they evaporate to a vapor. Due to the two-phase nature of the liquid metal medium for transporting heat, pool boiler 100 has the important advantage of nearly-isothermal operation, even when incident heat distribution from burner assembly 110 is non-uniform. For example, where burner assembly 110 must be intermittently operated, pool boiler 100 can maintain a nearly-isothermal operation where burner assembly operation 110 is only turned off for short durations.

Designs for pool boiler 100 as shown in FIG. 7 are readily understood in the art. One exemplary construction is disclosed in "Pool Boiler Heat Transport System for a 25 KWE Advanced Stirling Conversion System"; Anderson, W. G.; Rosenfield, J. H.; Saaski, E. L.; Noble, J.; and Tower, L.; Proceedings From the 25th Intersociety Energy Conversion Engineering Conference, Paper No. 900163, Vol. 5, 1990, pp. 268–273, herein incorporated by reference. Various other constructions for pool boilers can also be utilized. Additionally, various alternatively constructed heat transport systems that are interposed between a heat user 112 and a burner assembly 110 can also be utilized.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A burner assembly for a heater head of an external combustion engine, comprising:

a housing having a cavity sized to receive a heater head;

a matrix burner element carried by the housing and configured to transfer heat to a received heater head;

a fuel inlet communicating with the housing for delivering fuel to the matrix burner element; and an exhaust outlet communicating with the housing for delivering combustion gases from the matrix burner element to an exterior of the housing.

2. The burner assembly of claim 1 wherein the external combustion engine comprises a Stirling cycle machine.

3. The burner assembly of claim 1 wherein the housing cavity comprises a heat chamber, the exhaust outlet communicating with the heat chamber for delivering combustion gases from the matrix burner element to the exterior of the housing.

4. The burner assembly of claim 1 further comprising a heat transfer device interposed between the heater head and the matrix burner element.

5. The burner assembly of claim 4 wherein the heat transfer device comprises a pool boiler, combustion gases within a heat chamber of the housing cavity communicating with the heat transfer device to transfer heat via the pool boiler to the heater head.

6. The burner assembly of claim 4 wherein the heat transfer device comprises combustion gases within a heat chamber of the housing.

7. A burner assembly for a heater head of a Stirling cycle machine, comprising:

a housing having a cavity sized to receive a heater head;

a matrix burner element configured to encircle a received heater head in spaced apart relation;

a fuel inlet communicating with the housing for delivering fuel to the matrix burner element; and an exhaust outlet communicating with the housing for delivering combustion gases from between the matrix burner element and the received heater head, to the exterior of the housing.

8. The burner assembly of claim 7 wherein the housing cavity is configured to receive a monolithic heater head in spaced apart and substantially surface conforming relation with the matrix burner element.

9. The burner assembly of claim 7 wherein the matrix burner element comprises a metal fiber matrix burner element.

10. The burner assembly of claim 7 wherein the matrix burner element comprises a ceramic matrix burner element.

11. The burner assembly of claim 7 further comprising a collector interposed between the exhaust outlet and the matrix burner element, the collector directing high temperature, post-combustion exhaust gases in proximate fluid-flow relation across an end portion of the heater head.

12. A burner assembly for use on a monolithic heater head of a Stirling cycle machine, comprising:

a matrix burner element configured to substantially conform to the heater head in spaced apart and surface conforming relation; and a housing having an inlet for receiving a precombustion mixture of fuel/air and an exhaust outlet for removing combusted exhaust gases, the matrix burner element being carried by the housing between the inlet and the exhaust outlet, a plenum chamber being formed between the matrix burner element and an outer wall of the housing, and a heat chamber providing a combustion exhaust gas fluid flow path configured to heat the heater head and being formed between the matrix burner element and the heater head;

the plenum chamber operable to deliver the received precombustion mixture of gas/air to the matrix burner element where it is combusted.

13. The burner assembly of claim 12 wherein the matrix burner element encircles at least a portion of the heater head.

14. The burner assembly of claim 12 further comprising a collector interposed between the exhaust outlet and the matrix burner element, the collector directing high temperature, post-combustion exhaust gases in proximate fluid-flow relation across an end portion of the heater head.

15. The burner assembly of claim 14 wherein the collector comprises a frustoconically shaped exhaust member and the exhaust outlet comprises a cylindrical member affixed to a narrow end portion of the collector, a wide end portion of the collector being affixed to the housing adjacent to the matrix burner element.

16. The burner assembly of claim 12 wherein the housing comprises a burner housing and an exhaust housing fixedly retained together.

17. The burner assembly of claim 12 further comprising at least one mounting bracket fixed to the housing and configured to receive a fastener for removably mounting the burner assembly to a Stirling cycle machine.

18. The burner assembly of claim 12 wherein the housing comprises at least one cylindrical-shaped member.

19. The burner assembly of claim 12 wherein the matrix burner element comprises a cylindrical-shaped fiber matrix burner element.

20. The burner assembly of claim 12 wherein the plenum chamber comprises a circumferential cavity formed between the matrix burner element and an inner wall of the housing.

21. The burner assembly of claim 12 wherein the heat chamber comprises a circumferential cavity formed between an inner surface of the matrix burner element and a circumferential outer surface of a heater head being received in the heater assembly.

22. The burner assembly of claim 12 further comprising an insulation layer carried in the housing and extending circumferentially about a portion of the exhaust outlet.

23. The burner assembly of claim 12 further comprising a circumferentially extending insulation member interposed between the housing and the heater head, opposite the exhaust outlet.

24. The burner assembly of claim 12 wherein the matrix burner element comprises a metal fiber matrix burner element.

25. The burner assembly of claim 12 wherein the matrix burner element comprises a ceramic fiber matrix burner element.

26. The burner assembly of claim 12 further comprising a recuperator configured to transfer heat from the exhaust gas to the air or the fuel/air mixture in order to preheat the mixture prior to delivery via the inlet.

27. A burner assembly for use on a Stirling cycle machine, comprising:

a matrix burner element configured to encircle a radial outer periphery of a heater head on a Stirling cycle machine, the matrix burner element provided in spaced apart relation with the radial outer periphery of the heater head; and a housing having a fuel inlet and an exhaust outlet, the fiber matrix burner element being carried in the housing between the inlet and the exhaust outlet, a heat chamber being formed between the fiber matrix burner element and the heater head to provide a post-combustion exhaust gas fluid flow heating path;

the heat chamber operable to heat the heater head responsive to fuel combustion within the fiber matrix burner element.

28. The burner assembly of claim 27 wherein the housing is configured to receive a monolithic heater head in spaced apart and substantially surface conforming relation with the matrix burner element.

29. The burner assembly of claim 27 further comprising a plenum chamber formed between the matrix burner element and an inner wall of the housing, the plenum chamber being operable to deliver the received precombustion fuel to the matrix burner element where it is combusted.

30. The burner assembly of claim 27 wherein the matrix burner element comprises a metal fiber matrix burner element.

31. The burner assembly of claim 27 wherein the matrix burner element comprises a ceramic fiber matrix burner element.

32. The burner assembly of claim 27 further comprising a collector interposed between the exhaust outlet and the matrix burner element, the collector directing high temperature, post-combustion exhaust gases in proximate fluid-flow relation across an end portion of the heater head.

33. The burner assembly of claim 32 wherein the collector comprises a frustoconically shaped exhaust member and the exhaust outlet comprises a cylindrical member affixed to a narrow end portion of the collector, a wide end portion of the collector being affixed to the housing adjacent the matrix burner element.

34. A burner and engine assembly for generating power from a Stirling cycle machine, comprising:

a Stirling cycle power generator having a heater head for receiving a supply of heat;

a burner assembly carried over the heater head to form a heater for powering the generator, the burner assembly comprising:

a housing having a cavity sized to receive the heater head;

a matrix burner element configured to encircle the heater head in spaced apart relation;

a fuel inlet communicating with the housing for delivering fuel to the matrix burner element; and an exhaust outlet communicating with the housing for delivering combustion gases from between the matrix burner element and a received heater head, to the exterior of the housing.

35. The burner assembly of claim 34 wherein the heater head comprises a monolithic heater head, and the housing cavity is configured to receive the monolithic heater head in spaced apart and substantially surface conforming relation with the matrix burner element.

36. The burner assembly of claim 34 further comprising a collector interposed between the exhaust outlet and the matrix burner element, the collector directing high temperature, post-combustion exhaust gases in proximate fluid-flow relation across an end portion of the heater head.

37. The burner assembly of claim 34 wherein the matrix burner element comprises a metal fiber matrix burner element.

38. The burner assembly of claim 34 wherein the matrix burner element comprises a ceramic matrix burner element.

* * * * *

UNITED STATES PATENT AND TRADEMARK OFFICE

CERTIFICATE OF CORRECTION

PATENT NO. : 5,918,463

DATED : July 6, 1999

INVENTOR(S) : Laurence B. Penswick and Raymond M. Erbeznik

It is certified that error appears in the above-identified patent and that said Letters Patent is hereby corrected as shown below:

Column 9, line 14, delete "where burner assembly operation 110 is only turned off", and insert --where burner assembly 110 operation is only turned off--.

Signed and Sealed this
First Day of February, 2000

*Attest:*

*Attesting Officer*

Q. TODD DICKINSON

*Acting Commissioner of Patents and Trademarks*